US005460737A

United States Patent [19]

Sakai et al.

[11] Patent Number: 5,460,737

[45] Date of Patent: Oct. 24, 1995

[54] GRAPHITE-FREE LUBRICATING OIL

[75] Inventors: Kenji Sakai; Koichi Goto; Hitoshi Yokomizo; Kazuhiro Mitamura; Toshinori Kawai; Masatoshi Hirofuji, all of Kanagawa, Japan

[73] Assignees: Kyodo Yushi Co., Ltd., Tokyo; Nissan Motor Co., Ltd., Yokohama, both of Japan

[21] Appl. No.: 201,992

[22] Filed: Feb. 25, 1994

[30] Foreign Application Priority Data

Mar. 2, 1993 [JP] Japan ..... 5-041271

[51] Int. Cl.[6] ..... C10M 141/02

[52] U.S. Cl. ..... 252/25; 252/32.007 E; 252/34.7; 252/45; 252/56 R; 252/51.005 A; 252/51.005 R; 252/52 R; 72/42

[58] Field of Search ..... 252/29, 30, 52, 252/25, 32.7 E, 34.7, 45, 56 R, 51.5 A, 51.5 R; 72/42

[56] References Cited

U.S. PATENT DOCUMENTS

| | | | |
|---|---|---|---|
| 2,489,300 | 11/1949 | Leyda . | |
| 2,735,814 | 2/1956 | Hodson, Sr. et al. | 252/30 |
| 2,751,312 | 6/1956 | Ness . | |
| 3,813,335 | 5/1974 | Drobich et al. | 252/14 |
| 4,808,324 | 2/1989 | Périard et al. | 252/29 |

FOREIGN PATENT DOCUMENTS

| | | | |
|---|---|---|---|
| 0334977 | 10/1989 | European Pat. Off. . | |
| 291669 | 7/1991 | Germany | 72/42 |
| 021067 | 2/1978 | Japan | 72/42 |

OTHER PUBLICATIONS

Patent Abstracts of Japan, vol. 13, No. 182 (C–591), Apr. 27, 1989, JP–A–01 011 197, Jan. 13, 1989.

Patent Abstracts of Japan, vol. 13, No. 290 (C–614), Jul. 5, 1989, JP–A–01 085 295, Mar. 30, 1989.

Patent Abstracts of Japan, vol. 18, No. 40 (C–1155), Jan. 21, 1994, JP–A–05 263 092, Oct. 12, 1993.

Patent Abstracts of Japan, vol. 4, No. 7 (C–070), Jan. 19, 1980, JP–A–54 143 409, Nov. 8, 1979.

*Primary Examiner*—Jacqueline V. Howard

*Attorney, Agent, or Firm*—Oblon, Spivak, McClelland, Maier, & Neustadt

[57] ABSTRACT

A graphite-free lubricating oil which comprises a base oil having dispersed therein 10 to 40% by weight of a carbohydrate and/or a derivative thereof whose particle size ranges from 10 to 150 μm, 2 to 20% by weight of a film-boosting agent and 0.1 to 20% by weight of a dispersant. Moreover, the lubricating oil is free of black-colored substances such as graphite. Therefore, the oil permits the improvement of working surroundings and exhibits excellent properties such as formability through forging almost comparable to or even greater than that of the commercially available graphite-in-oil type lubricating oils. The lubricating oil can be used instead of the graphite-containing lubricating oils for warm forging, hot forging, rolling, tube-manufacturing, drawing and extrusion in place of the graphite-containing lubricating oils and ensures the improvement in the working surroundings and excellent lubricity.

8 Claims, No Drawings

GRAPHITE-FREE LUBRICATING OIL

BACKGROUND OF THE INVENTION

The present invention relates to a lubricating oil which is applied to the surface of a die during warm forging, hot forging, rolling, tube-manufacturing, drawing or extruding a material such as carbon steels, special steels or non-ferrous metals and which can be substituted for the graphite-containing lubricating oils and is effective for the improvement of working surroundings.

When the foregoing materials are subjected to various processing such as warm forging, hot forging, rolling, tube-manufacturing, drawing and extrusion, there have exclusively been employed lubricating oils to be supplied to the surface of a die during processing, which comprise graphite dispersed in oils or water. The lubricating oils comprising graphite dispersed in oils are excellent in lubricity, but have insufficient abilities of cooling dies. On the other hand, the lubricants comprising graphite dispersed in water have excellent abilities of cooling dies, but is insufficient in lubricity. For this reason, they are properly selected depending on the process conditions and put into practical use. In addition, either of these lubricants are black in appearance and correspondingly, suffer from a problem of dirt of working surroundings.

SUMMARY OF THE INVENTION

Accordingly, an object of the present invention is to provide a novel lubricating oil which does not cause dirt of working surroundings during various processings requiring good lubricity such as warm forging, hot forging, rolling, tube-manufacturing, drawing and extrusion unlike the conventional graphite-in-oil type lubricating oils and which has lubricity comparable to or rather superior to either of the foregoing lubricating oils and permits the extension of service life of machinery and tools to which the oil is applied.

The inventors of this invention have conducted various studies to solve the foregoing drawbacks associated with the conventional graphite-based lubricating oils and to develop a novel lubricating oil free of such drawbacks, have found out that the foregoing object of the present invention can effectively be accomplished through the use of a combination of a carbohydrate and/or a derivative thereof, a specific film-boosting agent and a specific dispersant and thus have completed the present invention.

The present invention thus provides a graphite-free lubricating oil comprising a base oil having dispersed therein 10 to 40% by weight (based on the total weight of the lubricating oil) of a carbohydrate and/or a derivative thereof whose particle size ranges from 10 to 150 μm, 2 to 20% by weight of a film-boosting agent and 0.1 to 20% by weight of a dispersant.

DESCRIPTION OF THE PREFERRED EMBODIMENTS

In the lubricating oil of the present invention, the foregoing three components, i.e., the carbohydrate and/or derivative thereof, the film-boosting agent and the dispersant are essential components indispensable to the intended effects of the present invention and these components must be used in the amounts defined above to accomplish the effects.

The lubricating oil of the present invention is used in warm forging, hot forging, rolling, tube-manufacturing, drawing and extruding. For simplicity, the lubricating oil will hereunder be explained while taking the warm forging which requires severe lubricating conditions. A lubricating oil can be obtained by mixing a specific carbohydrate and/or a derivative thereof and a specific film-boosting agent in a specific ratio and dispersing the resulting mixture in a heat-resistant base oil through the use of a specific dispersant. The lubricating oil thus produced has excellent lubricity and high heat stability comparable to those of the graphite-in-oil type ones. The lubricating oil of the invention does not cause the so-called "underfill" phenomenon in which deposits are accumulated on the inner wall of a die. The lubricating oil of the invention forms a film having a pale color which is favorable for the working surroundings.

The base oils to which the foregoing three essential components are added must have lubricity, must be in a liquid state at ordinary temperature, must be highly flame-retardant to an extent that they do not burn even when coming in contact with materials to be forged (temperature thereof generally ranging from 200° to 800° C.) and must be uniformly adhered to the surface of a die (temperature thereof generally ranging from 150° to 500° C.). Examples thereof are those having a flash point of not less than 250° C. such as refined mineral oils, α-olefin oligomers, polyphenyl ethers, glycerin esters of higher fatty acids (such as oleic acid glycerin ester, refined rape seed oil and refined rice oil), trimethylolpropane esters of higher fatty acids (such as trimethylolpropane oleic acid triester and trimethylolpropane isostearic acid triester), pentaerythritol esters of higher fatty acids (such as pentaerythritol oleic acid diester and pentaerythritol isostearic acid tetraester), hindered complex esters (available from Nippon Oils and Fats Co., Ltd. under the trade name of UNISTER C-3373H) and mixtures thereof, but the present invention is not restricted to these specific examples.

Examples of the carbohydrates and/or derivatives thereof used as the first component of the lubricating oil include all of the compounds whose chemical structure comprises, as the skeleton, carbohydrate moieties and which preferably have a molecular weight of not less than 5,000 and more preferably not less than 120,000. Particularly preferred examples thereof are starches, alkali metal salts of starch phosphates, celluloses derived from wooden fibers, alkali metal salts of cellulose phosphates, alkali metal alginates; and mixtures thereof. In this respect, the alkali metal salts are preferably lithium, sodium and potassium salts, with sodium salts being particularly preferred from the economical standpoint.

The lubricating mechanism of the carbohydrates and/or derivatives thereof during the warm forging has not yet been clearly elucidated. The carbohydrates and/or derivatives thereof per se are inferior in lubricity to graphite since they do not have heat resistance and cleavability comparable to those of graphite. However, when the particle size of the carbohydrates and/or derivatives thereof is adjusted to a predetermined level and is used in combination with the film-boosting agent as the second component, it is believed that they permit the formation of uniform and thick lubricant film required for the foregoing processing and exhibit formability comparable to or even superior to graphite. The term "formability" herein means the quality of the lubricating oil such that it can provide processed article having predetermined shape and size and can improve the service life of the die to a level greater than a target value. The particle size of the carbohydrates and/or derivatives ranges from 10 to 150 μm. This is because if the particle size is less than 10 μm, only a thin lubricant film is formed, the carbohydrates and/or derivatives thereof prematurely burn out as compared with graphite and accordingly they have low formability through forging. On the other hand, it exceeds 150 μm, they are insufficiently sprayed on a die, i.e., have low sprayability. The particle size thereof particularly preferably ranges from 20 to 50 μm and if they are classified through a wire gauze, preferred are those passing through a gauze of 400 mesh (37 μm). Commercially available carbohydrates and/or derivatives thereof which satisfy the foregoing requirement for the particle size include starches such as those derived from rice, wheat, corn, tapioca and potato. Preferred cellulosic substances are those obtained by hydrolyzing, for instance, pulp with an acid or an alkali, followed by filtration, water-washing, dehydration, drying, pulverization and classification through a sieve of 200 to 400 mesh.

The amount of these carbohydrates and/or derivatives thereof to be added to the lubricating oil ranges from 10 to 40% by weight. This is because if it is less than 10% by weight, the resulting lubricating oil has insufficient formability through forging, while if it exceeds 40% by weight, the resulting lubricating oil loses the fluidity and it is insufficiently sprayed on a die upon its supply. Incidentally, most of the commercially available carbohydrate derivatives contain water. In general, the ability of the lubricating oil per se to adhere to a die is impaired when the water content thereof is high. However, the lubricating oil preferably comprises a proper amount of water for inhibiting the combustion thereof. Accordingly, the water content of the carbohydrate and/or derivative thereof used in the invention preferably ranges from 1 to 7% by weight.

The "film-boosting agent" herein used as the second component of the lubricating oil means a substance capable of forming a tough lubricant film excellent in heat resistance, formability at an extreme pressure and capable of imparting excellent formability through forging when used in combination with the carbohydrates and/or derivatives thereof as compared with the latter per se. Specific examples thereof are dialkyl dithiocarbamate, 2-mercaptobenzothiazole, isopropyl xanthate, metal salts of dialkyl dithiophosphate (zinc, molybdenum and calcium salts), sulfurized lard, sulfur, di-tert-dodecylpolysulfide, tin sulfide, calcium sulfate, barium sulfate, tin pyrophosphate, calcium pyrophosphate, calcium hexametaphosphate, potassium polyphosphate, zinc oxide, molybdenum oxide, zinc carbonate, calcium carbonate, molybdenum carbonate, zinc molybdate, calcium molybdate and mixtures. Among these, preferred are dialkyl dithiocarbamates, dialkyl dithiophosphates, zinc, molybdenum and calcium salts with molybdic acid and carbonic acid, sulfurized lard having a sulfur content of 15 to 30% by weight, sulfur and mixtures thereof. In respect of molybdates, there have industrially been known basic salts in the form of mixed crystalline particles, for instance, (1) zinc oxide and zinc molybdate and (2) calcium oxide or calcium carbonate and calcium molybdate and these mixed crystals are also effectively used in the invention.

The film-boosting agent per se has formability inferior to that of the carbohydrates and/or derivatives thereof. The reason why the formability of the resulting lubricating oil is improved by simultaneous use thereof with the carbohydrates and/or derivatives thereof has not yet been clear, but it would be explained as follows. It is assumed that an organic film-boosting agent seems to serve for preventing seizure of a lubricating oil to a die and for reducing the surface temperature of the die during processing due to the action as a so-called extreme pressure agent or anti-wear agent and that the service life of the die is thus substantially extended. On the other hand, the carbohydrates and/or derivatives thereof burn at lower temperature and in shorter time than graphite does and it is therefore believed that an inorganic film-boosting agent serves for making the burning temperature higher and the burning time longer up to levels of approximately those of graphite, that the compound serves for maintaining the lubricant film during processing and even until when a processed article is released (knock out) from the die, that it serves for preventing seizure on the surface of the die and softening thereof due to the so-called flame-retardant effect of the tough lubricant film and the heat-insulation effect, in particular in case of forging, and that the service life of the die is thus substantially extended.

In this respect, the formability becomes conspicuous if the particle size of the inorganic compound is not more than 5 μ m and preferably not more than 0.5 μm. The film-boosting effect may be anticipated through the separate use of the organic or inorganic film-boosting agent, but the organic and inorganic film-boosting agents are preferably used in combination. The film-boosting agent is incorporated into the lubricating oil of the invention in an amount ranging from 2 to 20% by weight. This is because if it is less than 2% by weight, any marked effect of improving the formability through forging cannot be expected, while if it exceeds 20% by weight, the resulting lubricating oil has insufficient pumpability or sprayability. The weight ratio of the film-boosting agent to the carbohydrate and/or derivative thereof preferably ranges from 2:1 to 8:1.

The dispersants as the third component of the lubricating oil include all of the surfactants which are heat resistant, capable of stably dispersing the carbohydrate and/or derivative thereof as well as the film-boosting agent in a base oil and capable of forming a uniform film on the surface of a die. Typical examples thereof are sodium sulfonate, calcium sulfonate, calcium phenate, linear or branched $C_{12}$–$C_{22}$ monocarboxylic acid sorbitan triesters, linear or branched $C_{12}$–$C_{22}$ monocarboxylic acid sucrose esters, linear or branched $C_{12}$–$C_{22}$ monocarboxylic acid dextrin esters, linear or branched $C_{12}$–$C_{22}$ monocarboxylic acid cellulose esters, linear or branched $C_{12}$–$C_{22}$ monocarboxylic acid starch esters, hardened castor oil (particle size 5 μm under), stearyl bisamide, stearylpropylenediamine, stearylpropylenediamine dioleate, dimer acid salts of palmitylpropylenediamine, aluminum stearate, calcium salt of tallow fatty acid and mixtures thereof, but the present invention is not restricted to these specific examples. In this respect, the sulfonate and phenate are rather alkaline (having an alkali value (TBN) as expressed in terms of KOH/mg of not less than 10 and more preferably 20 to 400) than neutral in nature. The monocarboxylic acids are preferably saturated fatty acids because of their high heat resistance and the carbon atom number thereof most preferably ranges from 16 to 18. The dispersant is added to the lubricating oil in an amount ranging from 0.1 to 20% by weight. This is because if it is less than 0.1% by weight, the dispersant is incapable of uniformly dispersing the foregoing first and second components in the base oil, while if it exceeds 20% by weight, the resulting lubricating oil exhibits insufficient formability through forging and insufficient fluidity.

The lubricating oil of the invention may, if desired, comprise other known additives, for instance, powdery substances such as boron nitride, sericite, talc, zinc phosphate, potassium phosphate, calcium hydrogen phosphate, lithium hydrogen phosphate, boric acid, sodium borate, sodium silicate, zinc stearate, aluminum isophthalate and calcium trimellitate; adhesion-improving agents such as polymethacrylate and polyisobutylene; commercially available antioxidants; and flame-retardants.

The method for preparing the lubricating oil of the present invention comprises, as a first step, uniformly dissolving or dispersing a dispersant in a base oil. If the dispersant is powder, it is dissolved or dispersed under heating to at a temperature of not higher than 110° C. and then gradually adding a carbohydrate and/or a derivative thereof as well as a film-boosting agent to the oil while mixing with stirring to give a slurry-like composition. In a second step, the uniform dispersion is completed by treating the slurry-like composition with a three-roll mill or APV-Gaulin's Homogenizer (manufactured by APV-Gaulin Inc.; hereinafter referred to as "GAULIN homogenizer") to give a final product. This method for preparing the lubricating oil is herein given by way of example and the present invention is not restricted to this specific method.

The lubricating oil of the present invention thus prepared is supplied to a die through spraying in the form of an undiluted solution.

The present invention will be explained in more detail with reference to the following non-limitative working Examples and the effects practically attained by the present invention will also be discussed in detail in comparison with Comparative Examples.

EXAMPLE 1

A lubricating oil (Sample No. 1) was prepared from the components listed in the following Table 1 according to the method detailed below.

To a mixed oil comprising 33.0 parts by weight of a refined mineral oil as a base oil and 20.0 parts by weight of pentaerythritol oleic acid diester, there was added 2.0 parts by weight of cellulose stearic acid ester as a dispersant, the resulting mixture was uniformly dispersed with a stirring machine while heating at 100° C. for 30 minutes, then 5.0 parts by weight of calcium sulfonate was added to and uniformly dispersed at a temperature of 80° to 100° C. for 5 minutes in the mixture. Then the remaining components, i.e., 30.0 parts by weight of sodium salt of potato starch phosphate and 10.0 parts by weight of molybdenum dibutyl dithiocarbamate were in order added to the foregoing mixture and then the whole body was uniformly dispersed at a temperature of 50° to 80° C. for 5 minutes to obtain a slurry. The slurry was passed twice through GAULIN homogenizer at 350 kgf/cm$^2$ to give a lubricating oil (Sample No. 1).

EXAMPLES 2, 3, 5 TO 8, 10 AND 11

The same procedures used in Example 1 were repeated except that the base oil, carbohydrate, film-boosting agent and dispersant listed in Table 1 were used in amounts detailed in Table 1 to give lubricating oils (Sample Nos. 2, 3, 5 to 8, 10 and 11, respectively ).

EXAMPLE 4

To a mixed oil comprising 30.0 parts by weight of a refined mineral oil as a base oil, 15.0 parts by weight of pentaerythritol oleic acid diester and 30.0 parts by weight of UNISTER C-3373H, there was added 10.0 parts by weight of calcium phenate as a dispersant, the resulting mixture was uniformly dispersed with a stirring machine at a temperature of from room temperature to 50° C. for 5 minutes, then the remaining components, i.e., 10.0 parts by weight of sodium salt of tapioca starch phosphate and 5.0 parts by weight of molybdenum dibutyl dithiocarbamate were in order added to the foregoing mixture and then the whole body was uniformly dispersed at a temperature of from room temperature to 50° C. for 5 minutes to obtain a slurry. The slurry was passed twice through GAULIN homogenizer at 350 kgf/cm$^2$ to give a lubricating oil (Sample No. 4).

EXAMPLE 9

The same procedures used in Example 4 were repeated except that the base oil, carbohydrate, film-boosting agent and dispersant listed in Table 1 were used in amounts detailed in Table 1 to give a lubricating oil (Sample No. 9).

EXAMPLE 12

The same procedures used in Example 1 were repeated except that the base oil, carbohydrate, film-boosting agent and dispersant (powdery hardened castor oil) listed in Table 1 were used in amounts detailed in Table 1 and that the whole body was dispersed at a temperature of 65° to 75° C. since powdery hardened castor oil has the optimum dispersing temperature of 70° C. to give a lubricating oil (Sample No. 12).

Comparative Example 1

To a mixed oil comprising 29.0 parts by weight of a refined mineral oil as a base oil and 40.0 parts by weight of pentaerythritol oleic acid diester, there were in order added 20.0 parts by weight of cellulose powder, 10.0 parts by weight of calcium molybdate and 1.0 parts by weight of calcium carbonate and then the whole body was dispersed at a temperature of from room temperature to 50° C. for 5 minutes to obtain a slurry. The slurry thus prepared was passed twice through GAULIN homogenizer at 350 kgf/cm$^2$ to give a lubricating oil (Comp. Sample No. 1).

Comparative Examples 2 to 9

The same procedures used in Example 4 were repeated except that calcium sulfonate as a dispersant was substituted for calcium phenate used in Example 4 and that the components detailed in the following Table 2 were used in amounts likewise detailed in Table 2 to give lubricating oils (Comparative Sample Nos. 2 to 9).

The lubricating oils obtained in Examples 1 to 12 and Comparative Examples 1 to 9 as well as a commercially available graphite-in-oil type lubricating oil (Comparative Sample 10) and a commercially available graphite-in-water type lubricant (Comparative Sample 11) were inspected for various properties according to the test methods detailed below. The results thus obtained are also summarized in the following Tables 1 and 2.

Quality Identification

1. Formability: Laboratory Test (SRV Test)

Each Sample is subjected to a screening test for formability through forging using Schwingungs Reib und Verschieiss Tester. Friction coefficients are determined by operating the tester under the following conditions for bringing it close to the practical apparatus.

(Test Conditions)

① Test Piece: Ball (AISI 52100: Hypothetic punch and die); Cylinder(AISI 1045: Hypothetic Article to be Processed)

② Load: 100N (Heltz Pressure 222 kgf/mm$^2$)

③ Slip Speed: 240 mm/sec

④ Temperature: 750° C.

⑤ Time: 10 seconds

The friction coefficient should not be less than 0.10 in order to be in correspondence with the practical apparatus.

2. Formability: Laboratory Test (Backward Extrusion Test)

A test piece is forged by a small-sized forging machine under the following conditions and the formability through forging is evaluated on the basis of the relation between the load (ton) applied to the test piece during the forging and the bottom thickness (mm) of the forged test piece. The smaller the load and bottom thickness of the forged test piece, the better the formability.

(Test Conditions)

① Forging Machine: 160 ton. Mechanical Press

② Test Piece: AISI 1045 (diameter 30 mm; thickness 16 mm; and temperature 700° C.)

③ Speed: 32.5 mm/sec

④ Reduction of Area: 70% (punch diameter 25 mm)

⑤ Setting of Bottom Thickness: The bottom thickness is set in such a manner that the bottom thickness of a test piece, as determined after forging using Sample of Example 10, is equal to 3.30 mm.

(Evaluation)

The bottom thickness and load should be not more than 3.32 mm and not more than 75 tons, respectively in order to be in correspondence with the practical apparatus.

3. Formability: Test by Practical Apparatus

CVJ (constant velocity joint)(ball joint) outer race is subjected to warm forward extrusion in first to third steps and then to warm backward extrusion in 4th step. The formability of each lubricating oil is evaluated on the basis of the relative size of the forged parts and the service life of the die.

(Evaluation Criteria)

○: Parts having a predetermined size are provided and the service life of the die is comparable to or greater than that attained by Sample of Example 10.

□: Parts having a predetermined size are provided, but the service life of the die is from less than 100% to 80% of that attained by Sample of Example 10.

Δ: Parts having a predetermined size are provided, but the service life of the die is less than 80% of that attained by Sample of Example 10.

X: Parts having a predetermined size are not provided.

4. Sprayability: Test by Practical Apparatus

In this test, it is confirmed whether a specific Sample can be sprayed at a predetermined flow rate or not, when it is subjected to airless spray under a pressure ranging from 100 to 200 kgf/cm$^2$ through a plunger pump and whether a predetermined spray angle is ensured or not.

(Evaluation Criteria)

○: A predetermined flow rate is provided and a desired spray angle can be ensured.

X: A predetermined flow rate is not provided due to, for instance, clogging of a nozzle.

5. Dirt of Die Set: Test by Practical Apparatus

Each Sample is inspected for possibility of dirty working surroundings, for instance, deposition of the excessively supplied Sample as black deposits (as observed, in particular, when the graphite-containing oil is used) and loss of fluidity of the sample through polymerization (polymerized sample cannot be removed with a spatula).

(Evaluation Criteria)

○: Working surroundings are not dirty.

X: Die set is colored black and/or a polymer film is formed thereon.

6. Self-Extinguishing Property: Test by Practical Apparatus

A sample supplied to a die sometimes ignites and burns when a test piece to be forged is inserted into the die. In such case, it is usual to use compressed air to immediately extinguish the flame. In this test, it is confirmed whether the flame can be immediately extinguished or not.

(Evaluation Criteria)

○: Ignites and burns, but immediately self-extinguishes.

X: Ignites and burns, but cannot extinguish even by blowing compressed air thereon.

7. Synthetic Evaluation

The lubricating oil used in the warm forging should have sprayability, formability, dirt of die set and self-extinguishing property which are all ranked as "○" in the foregoing evaluation criteria.

TABLE 1

| | Sample No.(Present invention) | | | | | |
|---|---|---|---|---|---|---|
| Items | 1 | 2 | 3 | 4 | 5 | 6 |
| Base Oil | | | | | | |
| refined mineral oil ISO VG460 | 33.0 | 17.0 | 33.8 | 30.0 | 22.0 | 23.5 |
| pentaerythritol oleic acid diester | 20.0 | — | — | 15.0 | 40.0 | 40.0 |
| trimethylolpropane oleic acid triester | — | 40.0 | 20.0 | — | — | — |
| hindered complex ester(Trade Name: UNISTER C-3373H) | — | — | — | 30.0 | — | — |
| Carbohydrates | | | | | | |
| sodium salt of potato starch phosphate (particle size: 35 μm) | 30.0 | 30.0 | — | — | — | — |
| sodium salt of tapioca starch phosphate (particle size: 20 μm) | — | — | 35.0 | 10.0 | — | — |
| cellulose powder (pass through 400 mesh sieve (particle size: about 24 μm) | — | — | — | — | 20.0 | 20.0 |
| Film-Boosting Agent | | | | | | |
| molybdenum dibutyldithiocarbamate | 10.0 | 10.0 | — | 5.0 | — | — |

TABLE 1-continued

| | | | | | | |
|---|---|---|---|---|---|---|
| zinc dibutyldithiophosphate | — | — | 10.0 | — | — | — |
| zinc molybdate (particle size: 2 μm) | — | — | — | — | 10.0 | — |
| Ca molybdate (particle size: 2 μm) | — | — | — | — | — | 10.0 |
| Ca carbonate (particle size: 0.05 μm) | — | 1.0 | 1.0 | — | 1.0 | 1.0 |
| sulfurized lard (sulfur content: 20% by weight) | — | — | — | — | — | — |
| Dispersant | | | | | | |
| cellulose stearate | 2.0 | — | 0.2 | — | — | — |
| dextrin palmitate | — | 1.0 | — | — | 2.0 | 0.5 |
| calcium sulfonate (TBN = 25) | 5.0 | — | — | — | 5.0 | — |
| calcium phenate (TBN = 150) | — | 5.0 | — | 10.0 | — | 5.0 |
| Appearance of Sample (at ordinary Temp.) | yellow | yellow | ocher | yellow | pale yellow | pale yellow |
| Formability | | | | | | |
| Laboratory: SRV Test (750° C.) Frictional Coeff. | 0.051 | 0.046 | 0.059 | 0.096 | 0.049 | 0.067 |
| Laboratory Backward Extrusion Test; 700° C.(Thickness/load) | 3.30/74t | 3.30/73t | 3.30/74t | 3.32/75t | 3.29/73t | 3.30/74t |
| Test by Practical Apparatus (1600 t Press) | ○ | ○ | ○ | ○ | ○ | ○ |
| Sprayability | ○ | ○ | ○ | ○ | ○ | ○ |
| Dirt of Die Set | ○ | ○ | ○ | ○ | ○ | ○ |
| Self-Extinguishing Property | ○ | ○ | ○ | ○ | ○ | ○ |

| | Sample No. (Present Invention) | | | | | |
|---|---|---|---|---|---|---|
| Items | 7 | 8 | 9 | 10 | 11 | 12 |
| Base Oil | | | | | | |
| refined mineral oil ISO VG460 | 23.5 | — | — | 35.5 | — | 20.0 |
| pentaerythritol oleic acid diester | — | — | — | — | 18.0 | — |
| trimethylolpropane oleic acid triester | 40.0 | — | 28.0 | 20.0 | 20.0 | — |
| hindered complex ester(Trade Name: UNISTER C-3373H) | — | 75.0 | — | — | — | — |
| refined rape seed oil | — | — | — | — | — | 43.5 |
| Carbohydrates | | | | | | |
| sodium salt of potato starch phosphate (particle size: 35 μm) | — | — | — | 15.0 | 20.0 | — |
| sodium salt of tapioca starch phosphate (particle size: 20 μm) | — | — | — | 15.0 | 20.0 | — |
| cellulose powder (pass through 400 mesh sieve (particle size: about 24 μm) | 20.0 | 10.0 | 35.0 | — | — | 20.0 |
| Film-Boosting Agent | | | | | | |
| molybdenum dibutyldithiocarbamate | — | 10.0 | — | — | — | — |
| zinc dibutyldithiophosphate | — | — | 15.0 | 5.0 | — | — |
| zinc molybdate (particle size: 2 μm) | 3.0 | 2.0 | — | — | — | 3.0 |
| Ca molybdate (particle size: 2 μm) | 3.0 | 2.0 | 1.0 | — | — | 3.0 |
| Ca carbonate (particle size: 0.05 μm) | 2.0 | — | 1.0 | — | — | 2.0 |
| sulfurized lard (sulfur content: 20% by weight) | — | — | — | — | 20.0 | — |
| Dispersant | | | | | | |
| cellulose stearate | — | 1.0 | — | 2.0 | — | |
| dextrin palmitate | 1.0 | — | — | 2.0 | — | — |
| calcium sulfonate (TBN = 25) | — | — | 20.0 | 7.5 | — | — |
| calcium phenate (TBN = 150) | 7.5 | — | — | — | — | 7.5 |
| hardened castor oil | — | — | — | — | — | 1.0 |

TABLE 1-continued

| | | | | | | |
|---|---|---|---|---|---|---|
| Appearance of Sample (at ordinary Temp.) | pale yellow | yellow | pale yellow | ocher | ocher | yellow |
| Formability | | | | | | |
| Laboratory: SRV Test (750° C.) Frictional Coeff. | 0.055 | 0.090 | 0.055 | 0.096 | 0.046 | 0.057 |
| Laboratory Backward Extrusion Test; 700° C.(Thickness/load) | 3.31/ 74t | 3.32/ 75t | 3.30 73t | 3.31 75t | 3.29/ 73t | 3.31 74t |
| Test by Practical Apparatus (1600 t Press) | ○ | ○ | ○ | ○ | ○ | ○ |
| Sprayability | ○ | ○ | ○ | ○ | ○ | ○ |
| Dirt of Die Set | ○ | ○ | ○ | ○ | ○ | ○ |
| Self-Extinguishing Property | ○ | ○ | ○ | ○ | ○ | ○ |

TABLE 2

| | Comparative Sample No. | | | | | |
|---|---|---|---|---|---|---|
| Items | 1 | 2 | 3 | 4 | 5 | 6 |
| Base Oil | | | | | | |
| refined mineral oil ISO VG460 | 29.0 | — | — | 40.0 | — | 24.0 |
| pentaerythritol oleic acid diester | 40.0 | 45.0 | — | 40.0 | 50.0 | — |
| refined rape seed oil | — | — | 45.0 | — | — | 50.0 |
| Graphite (particle size: 5 μm) | — | — | — | — | — | — |
| Carbohydrates | | | | | | |
| sodium salt of tapioca starch phosphate (particle size: 20 μm) | — | 10.0 | — | 7.5 | — | — |
| cellulose powder (pass through 50 mesh sieve (particle size: about 192 μm) | 20.0 | — | — | — | — | — |
| cellulose powder (pass through 400 mesh sieve (particle size: about 24 μm) | — | — | 45.0 | — | 20.0 | 20.0 |
| super high molecular weight polyethylene (MW = 2,000,000; particle size: about 30 μm) | — | — | — | — | — | — |
| polyphenylene sulfide resin (particle size: 50 μm) | — | — | — | — | — | — |
| Film-Boosting Agent | | | | | | |
| zinc dibutyldithiophosphate | — | 10.0 | — | 5.0 | — | 1.0 |
| Ca molybdate (particle size: 2 μm) | 10.0 | 10.0 | — | 25.0 | — | — |
| Ca carbonate (particle size: 10 μm) | 1.0 | — | — | — | — | — |
| calcium sulfonate(TBN = 25) | — | 25.0 | 10.0 | 7.5 | 5.0 | 5.0 |
| commercially available graphite-in-oil type lubricating oil | — | — | — | — | — | — |
| commercially available graphite-in-water type lubricant (20% aqueous solution) | — | — | — | — | — | — |
| Appearance of Sample (at ordinary Temp.) | pale yellow | pale yellow | ocher | ocher | pale yellow | ocher |
| Formability | | | | | | |
| Laboratory: SRV Test (750° C.) Frictional Coeff. | 0.056 | 0.103 | 0.079 | 0.162 | 0.129 | 0.107 |
| Laboratory Backward Extrusion Test; 700° C. (Thickness/load) | 3.29/ 73t | 3.33/ 74t | 3.32/ 75t | 3.51/ 83t | 3.37/ 76t | 3.33/ 75t |
| Test by Practical Apparatus (1600 t Press) | X | Δ | X | Δ | X | □ |
| Sprayability | X | ○ | X | ○ | X | ○ |

TABLE 2-continued

| | | | | | |
|---|---|---|---|---|---|
| Dirt of Die Set | — | ○ | — | ○ | — | ○ |
| Self-Extinguishing Property | — | ○ | — | X | — | X |

| | Comparative Sample No. | | | | |
|---|---|---|---|---|---|
| Items | 7 | 8 | 9 | 10 | 11 |
| Base Oil | | | | | |
| refined mineral oil ISO VG460 | 25.0 | 25.0 | 35.0 | — | — |
| pentaerythritol oleic acid diester | — | — | — | — | — |
| refined rape seed oil | 40.0 | 40.0 | 40.0 | — | — |
| Graphite (particle size: 5 μm) | 20.0 | — | — | — | — |
| Carbohydrates | | | | | |
| sodium salt of tapioca starch phosphate (particle size: 20 μm) | — | — | — | — | — |
| cellulose powder (pass through 50 mesh sieve (particle size: about 192 μm) | — | — | — | — | — |
| cellulose powder (pass through 400 mesh sieve (particle size: about 24 μm) | — | — | — | — | — |
| super high molecular weight polyethylene (MW = 2,000,000; particle size: about 30 μm) | — | 30.0 | — | — | — |
| polyphenylene sulfide resin (particle size: 50 μm) | — | — | 20.0 | — | — |
| Film-Boosting Agent | | | | | |
| zinc dibutyldithiophosphate | — | — | — | — | — |
| Ca molybdate (particle size: 2 μm) | — | — | — | — | — |
| Ca carbonate (particle size: 10 μm) | — | — | — | — | — |
| calcium sulfonate(TBN = 25) | 5.0 | 5.0 | 5.0 | — | — |
| commercially available graphite-in-oil type lubricating oil | — | — | — | 100 | — |
| commercially available graphite-in-water type lubricant (20% aqueous solution) | — | — | — | — | 100 |
| Appearance of Sample (at ordinary Temp.) | black | pale yellow | ocher | black | black |
| Formability | | | | | |
| Laboratory: SRV Test (750° C.) Frictional Coeff. | 0.098 | 0.115 | 0.094 | 0.040 | 0.190 |
| Laboratory Backward Extrusion Test; 700° C. (Thickness/load) | 3.32/76t | 3.32/75t | 3.31/75t | 3.30/74t | 3.51/82t |
| Test by Practical Apparatus (1600t Press) | □ | Δ | □ | ○ | X |
| Sprayability | ○ | ○ | ○ | ○ | ○ |
| Dirt of Die Set | X | X | X | X | X |
| Self-Extinguishing Property | X | — | X | ○ | ○ |

As has been explained above in detail and as seen from the results listed in Tables 1 and 2, the lubricating oil of the present invention comprises a specific carbohydrate (and/or derivative thereof), a specific film-boosting agent and a specific dispersant uniformly dispersed in a base oil in a specific mixing ratio and is free of black-colored substances such as graphite. Therefore, the lubricating oil permits the improvement of working surroundings and exhibits excellent properties such as formability through forging almost comparable to or even greater than that of the commercially available graphite-in-oil type lubricating oil (see Comparative Example 10).

Accordingly, the lubricating oil of the present invention can be used instead of the graphite-containing lubricating oils for warm forging and ensures the improvement in the working surroundings. Moreover, the lubricating oil of the present invention can likewise be used in hot forging, rolling, tube-manufacturing, drawing and extrusion processes in place of the graphite-containing lubricating oils, and likewise ensures the improvement in the working surroundings and can provide excellent lubricity.

What is claimed is:

1. A graphite-free lubricating oil comprising a base oil having dispersed therein 10 to 40% by weight of a carbohydrate and/or a derivative thereof whose particle size ranges from 10 to 150 μm, 2 to 20% by weight of a film-boosting agent and 0.1 to 20% by weight of a dispersant, wherein the dispersant is a member selected from the group consisting of sodium sulfonate, calcium sulfonate, calcium phenate, linear or branched $C_{12}$–$C_{22}$ monocarboxylic acid sorbitan triesters, linear or branched $C_{12}$–$C_{22}$ monocarboxylic acid sucrose esters, linear or branched $C_{12}$–$C_{22}$ monocarboxylic acid dextrin esters, linear or branched $C_{12}$–$C_{22}$ monocarboxylic acid cellulose esters, linear or branched $C_{12}$–$C_{22}$ monocarboxylic acid starch esters, hardened castor oil, stearyl bisamide, stearylpropylenediamine, stearylpropylenediamine dioleate, dimer acid salts of palmitylpropylenediamine, aluminum stearate, calcium salt of tallow fatty acid and mixtures thereof.

2. The lubricating oil of claim 1 wherein the base oil is at least one member selected from the group consisting of refined mineral oils, α-olefin oligomers, polyphenyl ethers, glycerin esters of higher fatty acids, trimethylolpropane esters of higher fatty acids, pentaerythritol esters of higher fatty acids, hindered complex esters and mixtures thereof.

3. The lubricating oil of claim 1 wherein the carbohydrate and/or derivative thereof are compounds whose chemical structure comprises, as the skeleton, carbohydrate moieties and which have a molecular weight of not less than 5,000.

4. The lubricating oil of claim 3 wherein the carbohydrate and/or derivative thereof is at least one member selected from the group consisting of starches, alkali metal salts of starch phosphates, celluloses derived from wooden fibers, alkali metal salts of cellulose phosphates, alkali metal alginates; and mixtures thereof.

5. The lubricating oil of claim 1 wherein the carbohydrate and/or derivative thereof have a particle size ranging from 20 to 50 μm.

6. The lubricating oil of claim 1 wherein the carbohydrate and/or derivative thereof comprise moisture in an amount ranging from 1 to 7% by weight.

7. The lubricating oil of claim 1 wherein the film-boosting agent is a member selected from the group consisting of dialkyl dithiocarbamates, dialkyl dithiophosphates, dialkyl dithiocarbamate, 2-mercaptobenzothiazole, isopropyl xanthate, zinc dialkyl dithiophosphate, molybdenum dialkyl dithiophosphate, calcium dialkyl dithiophosphate, sulfurized lard, sulfur, di-tert-dodecylpolysulfide, tin sulfide, calcium sulfate, barium sulfate, tin pyrophosphate, calcium pyrophosphate, calcium hexametaphosphate, potassium polyphosphate, zinc oxide, molybdenum oxide, zinc carbonate, calcium carbonate, molybdenum carbonate, zinc molybdate, calcium molybdate and mixtures thereof.

8. The lubricating oil of claim 1 wherein the weight ratio of the film-boosting agent to the carbohydrate and/or derivative thereof ranges from 2:1 to 8:1.

* * * * *